United States Patent [19]

Tom

[11] Patent Number: 4,574,866

[45] Date of Patent: Mar. 11, 1986

[54] INVESTMENT CASTING USING HOLLOW METAL FORM

[76] Inventor: Leung Tom, 6524 Bruton Rd., Cartierville, Quebec, Canada

[21] Appl. No.: 665,012

[22] Filed: Oct. 26, 1984

Related U.S. Application Data

[63] Continuation-in-part of Ser. No. 347,011, Feb. 8, 1982, abandoned.

[51] Int. Cl.[4] ..... B22C 7/00; B22C 9/04

[52] U.S. Cl. ..... 164/35; 164/244; 164/246; 164/361

[58] Field of Search ..... 164/35, 34, 493, 513, 164/244, 246, 350, 361

[56] References Cited

U.S. PATENT DOCUMENTS 3,052,001 9/1962 Brennan ..... 164/513
3,177,537 4/1965 Horton ..... 164/35

FOREIGN PATENT DOCUMENTS 50-32062 10/1975 Japan ..... 164/35
51-12326 1/1976 Japan ..... 164/35

*Primary Examiner*—Nicholas P. Godici
*Assistant Examiner*—J. Reed Batten, Jr.
*Attorney, Agent, or Firm*—Robert J. Schaap; Eric Fincham

[57] ABSTRACT

In an investment casting method, a wax coating is provided to the exterior and interior surfaces of a thin-walled hollow metallic form. The wax coating on the exterior and interior surfaces is coated with a mold forming material. When the metallic form is heated, the wax will melt permitting removal of the form.

7 Claims, 4 Drawing Figures

INVESTMENT CASTING USING HOLLOW METAL FORM

This application is a continuation-in-part of co-pending application Ser. No. 347,011 filed Feb. 8, 1982 and now abandoned.

The present invention relates to a method and apparatus and more particularly, relates to improvements in an investment casting process and apparatus.

The investment casting art, which is an old one, utilizes an initial metal mold which is constructed to permit the reproduction of a plurality of disposable patterns, normally of a wax material. Conventionally, a plurality of the wax patterns, representing the articles to be cast, are attached by means of wax gates to a wax form to form a pattern cluster. The pattern cluster is then coated with one or more coats of a refractory material or alternatively, invested in a plaster mold to form a mold about the wax pattern. Following curing and/or hardening of the material forming the shell about the patterns and forms, the disposable material is removed to leave a completely void pattern cavity and as well, the forms are also removed.

Various proposals have been advanced in the art with respect to the minimization of the use of wax in the forms. As will be appreciated the wax forms used in the process require a considerable amount of material and in addition, the removal of the wax material forming the forms or sprues requires a considerable amount of energy since heat must be applied to remove the forms. Not only does the use of solid wax forms require an expenditure of additional energy, a time factor in the order of 6 to 10 minutes or more is required. Naturally, the minimization of the time and energy required is desirable.

Still further, the wax forms or sprues represent a "weak link" in the investment casting art. Thus, it is known that cracking of the mold can occur when the wax sprue expands as it is being heated for removal of the same. It is naturally desirable that this be avoided.

More recently, a problem which has been encountered with respect to the wax sprues is the weakness of the same. Automation of production has, in some instances, been limited due to the inherent weakness of the wax sprues. Thus, the speed at which the pattern cluster can be rotated in the refractory material is limited due to the inherent strength of the wax form.

It is known in the art, from U.S. Pat. No. 3,177,537 to use a metal form in place of a wax form. The metal form is coated with a thin layer of wax which permits the attachment of the patterns thereto. The use of the metal form reduces the amount of wax material used and in addition, the metal form can be readily reused with a minimum expenditure of time and energy.

The metal form, with its thin wax coating, is removed first from the pattern cluster, according to the teachings of the aforementioned U.S. patent, by filling the form with a hot heat transfer material such as oil. This melts the thin wax coating and the metal form can then be easily slipped out of the cluster and reused to form a new cluster while the remainder of the pattern cluster is dewaxed in a normal manner to remove the wax gates and patterns.

The use of hot oil or a further heat transfer material is, however, awkward and time consuming. Furthermore the oil must be separately heated, transferred to the form, and then dumped from the form. Also, such a system still requires the entire runner system be filled with metal and as will be appreciated by those knowledgeable in the art, this can lead to a substantial expense.

It is an object of the present invention to provide a method for use in investment casting wherein the amount of metal required is substantially less than previously required. It is a further object of the present invention to provide an improvement in an investment casting process wherein the amount of metal utilized in the runner system is minimized.

In accordance with the present invention, there is provided a cylindrical metal form which is thinly coated with wax material, both on the inside and outside. Wax patterns of the articles to be cast are then attached by gates to the exterior of the wax covered metal form. Mold forming material is then applied about the wax to form a shell. Subsequently, the metal form is induction heated to allow its removal from the cluster and one is thus provided with a mold wherein the amount of metal material used in the form systems is minimized.

The induction heating means employed may be any conventional induction coil; it is preferred that radio frequency be employed. In general terms, a frequency of 60 to 10,00 Hertz is a preferred range. It is particularly preferred that the induction coil be situated as close as possible to the tubular metal form to increase the coupling efficiency. Although the induction coil can be placed exteriorly of the pattern cluster, interior placement of the coil within the tubular or cylindrical form provides maximum efficiency and convenience. Furthermore, it is preferred that the tubular metal form be of a relatively thin material to permit a rapid heat build-up. It has been found that employing a method such as above described, the metal form can be removed from the set-up in a period of under 10 seconds.

In preferred embodiments of the invention, the metal form would typically be in the order of 40 to 150 thousandth of an inch thickness. As aforementioned, it is preferable that it be as thin as possible; the limiting factor is typically any deformation which may occur as a result of the mechanical stress or external heating. An aluminum and/or aluminum alloy is a suitable material for the metal form. The wax layer is also preferably extremely thin and would be in the range of 0.005 to 0.05 inch or more The invention will now be described in detail having reference to the accompanying drawings in which:

Figure 1:
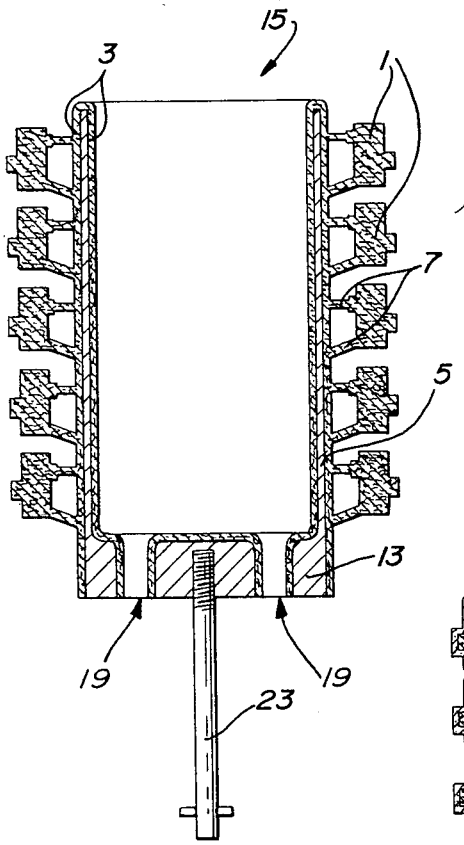
FIG. 1 is a sectional view of a pattern cluster.

In the investment casting process of the present invention a plurality of wax patterns 1 of the article to be cast are attached to a thin wax coating 3 applied on a tubular metal form 5. The patterns 1 are attached by means of wax gates 7. The tubular metal form 5 preferably is a thin-walled cylindrical tube having an open end 15 and a closed end, called a sprue end 13. Sprue end 13 has two drainage holes 19. Form 5 can be made from aluminum, aluminum alloys or other suitable metal materials known to those skilled in the art. The assembled patterns 1, form 5 and gates 7 form what is known as a pattern cluster as shown in FIG. 1.

Figure 2:
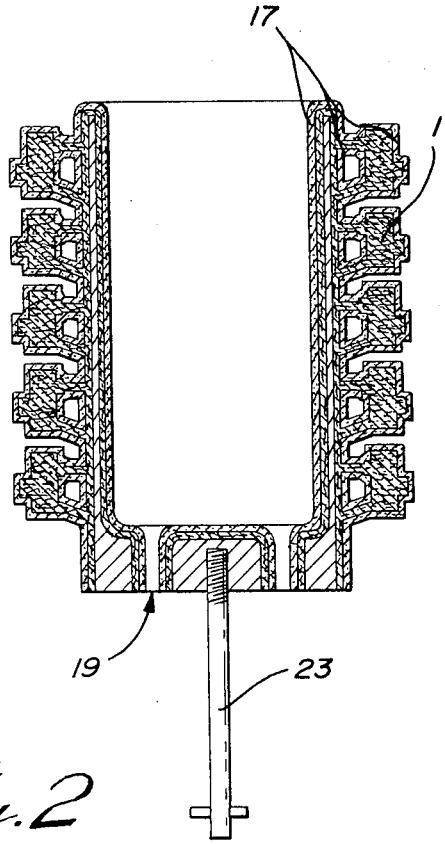
FIG. 2 is a sectional view of the pattern cluster after coating with mold forming material.

The pattern cluster is then dipped into a slurry to form a shell 17 of mold forming material as shown in FIG. 2. The shell 17 of mold forming material can be applied by dipping the cluster in a ceramic slurry and then stuccoing refractory grain onto the slurry coated pattern cluster surface either by vibrating screen or immersion in a fluidized bed. When the pattern cluster is dipped into a slurry/fluidized bed, the resistance to immersion is minimized by means of apertures 19. As will be seen from FIG. 2, shell 17 is formed both on the inside and outside of metal form 5.

Figure 3:
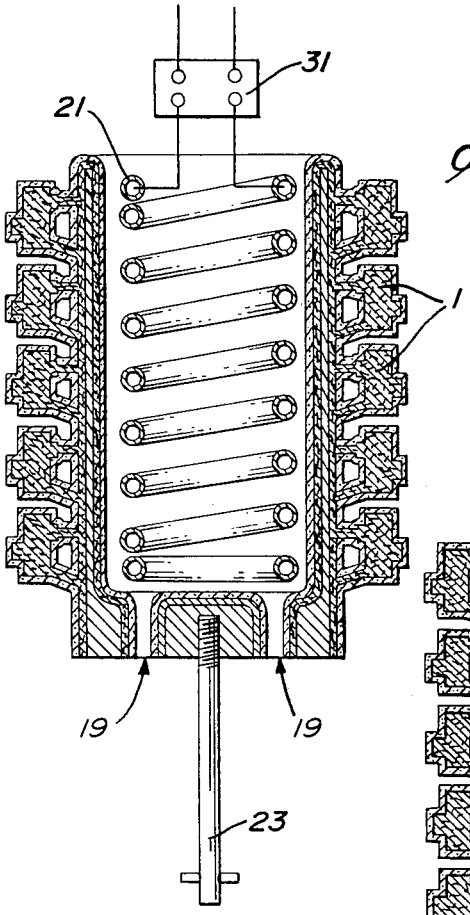
FIG. 3 is a sectional view of the coated pattern cluster being heated by an induction heating coil.
Figure 4:
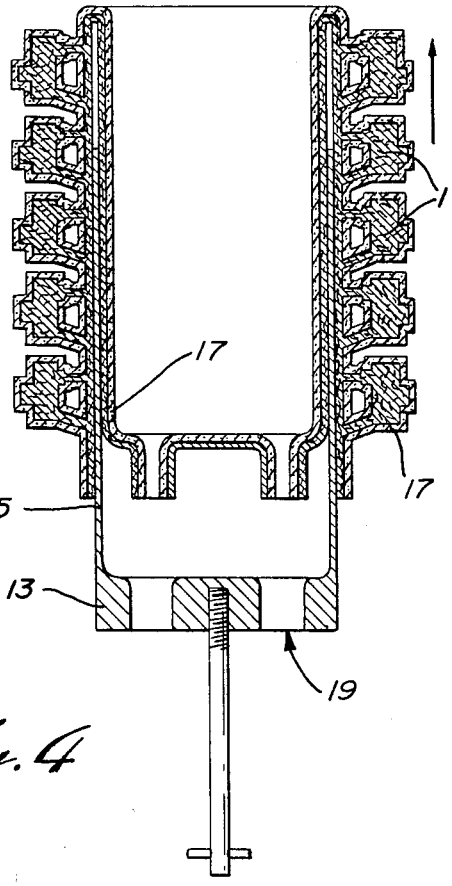
FIG. 4 is a sectional view showing removal of the metal form from the pattern cluster.

The coated pattern cluster with the dried shell 17, is then supported by suitable means while an induction coil 21, as shown in FIG. 3, is placed inside the metal form. The cluster can be manipulated by a steel handle rod 23. The cluster is generally supported to have the longitudinal axis of the tubular form coincide with the central longitudinal axis of the induction coil 21. Current is then passed through the induction coil 21 from a source via suitable control means 31 in a manner so as to inductively heat the tubular metal form 5. When the form 5 is heated, the thin outer wax coating 3 on the form melts and runs down the form and out of the shell 17 past through the sprue end 13. The form 5 can now easily be slipped out of the shell 17 as shown in FIG. 4, by raising the shell, and the form can be reused. The remainder of the wax in the patterns 1 is then separately dewaxed to remove the wax patterns and gates from the shell 17; and the shell 17 is then filled with molten metal to cast the articles.

As may be seen from FIG. 4, following removal of the remainder of the wax, one is left with shell 17 which, when cast with metal, will use substantially less material in the runner system than is the case in the prior art. Also, various problems with heat transfer and cracking of the shell can be avoided utilizing this method.

It will be understood that the above described embodiment is for purposes of illustration only and changes and modifications may be made thereto without departing from the spirit and scope of the invention. Thus, for example, although the induction coil is shown interiorly of the metal form 5, one could, in certain circumstances, replace the induction coil exteriorly of the pattern cluster.

I claim:

1. A method for use in investment casting comprising the steps of:

providing a hollow metal form;

applying a wax coating to the exterior surface and to the interior surface of the hollow metal form;

providing a pattern cluster having a plurality of wax patterns of articles to be cast attached with wax gates to said wax coated hollow metal form;

coating the pattern cluster with mold forming material to form a shell both interiorly and exteriorly of the hollow metal form;

induction heating the metal form to cause the metal form to heat to a temperature sufficient to melt the wax thereof and thereby form a mold comprising the shell;

removing the metal form to thereby leave a runner system for introduction of molten metal into the mold which minimizes the amount of metal employed in the runner system.

2. The method of claim 1 wherein the step of induction heating the metal form comprises placing an induction heating coil interiorly of the coated metal form.

3. The method of claim 1 wherein said metal form is of a cylindrical configuration having one end thereof open and an opposed end having at least one drainage aperture therein.

4. The method of claim 2 wherein the current frequency to the induction heating coil is between 60 Hertz and 10,000 Hertz.

5. In an investment casting method, wherein a cluster of wax patterns of articles to be cast are attached to a form, the improvement comprising the steps of providing a thin-walled hollow metallic form having interior and exterior surfaces with a wax coating on the interior and exterior surfaces thereof, the wax patterns being attached to the wax coating on the exterior surface of the metal form, coating both the interior and exterior surfaces of the metal form with mold forming material, and induction heating said metal form to a temperature sufficient to thereby cause said wax coating to melt and permit removal of said metal form and to thereby leave a form for the introduction of molten metal material which minimizes the use of said molten metal material.

6. The method of claim 5 wherein said metal form has a cylindrical configuration having one end thereof open and an opposed end having at least one drainage aperture therein.

7. An investment casting set-up comprising a cylindrical metal form having interior and exterior surfaces with a first open end and a second opposed end and with at least one drainage aperture therein, a wax coating on both the interior and exterior surfaces of said metal form, at least one wax pattern of an article to be cast attached by a wax gate to the exterior of the wax covered metal form, and a coating of a mold forming material about both the exterior and interior surfaces of the metal form.

* * * * *